US005332209A

United States Patent [19]

Romansky et al.

[11] Patent Number: 5,332,209

[45] Date of Patent: Jul. 26, 1994

[54] ADJUSTABLE FEED TRAY ASSEMBLY

[75] Inventors: John A. Romansky, Hilton; Randall R. Maysick, Churchville, both of N.Y.

[73] Assignee: Eastman Kodak Company, Rochester, N.Y.

[21] Appl. No.: 145,056

[22] Filed: Oct. 27, 1993

[51] Int. Cl.[5] ..... B65H 1/00

[52] U.S. Cl. ..... 271/171; 271/253; 271/240

[58] Field of Search ..... 271/171, 234, 239, 240, 271/248, 253, 255

[56] References Cited

U.S. PATENT DOCUMENTS

| | | | |
|---|---|---|---|
| 3,406,964 | 10/1968 | Eichorn | 50/26 |
| 4,780,740 | 10/1988 | Fukae | 355/3 |
| 4,907,792 | 3/1990 | Washiashi et al. | 271/253 X |
| 4,949,134 | 8/1990 | Iwaki et al. | 271/240 X |
| 5,014,091 | 5/1991 | Koike et al. | 355/321 |
| 5,148,228 | 9/1992 | Takano | 355/308 |

FOREIGN PATENT DOCUMENTS

| | | | |
|---|---|---|---|
| 0215431 | 9/1987 | Japan | 271/171 |
| 0231760 | 9/1989 | Japan | 271/240 |
| 4023778 | 1/1992 | Japan | 271/171 |

*Primary Examiner*—Robert P. Olsewski
*Assistant Examiner*—Carol L. Druzbick
*Attorney, Agent, or Firm*—Dennis R. Arndt

[57] ABSTRACT

An image recording apparatus wherein paper sheets are fed to a transport system along a predetermined feed path having a center line. The apparatus is provided with a pair of edge guides opposedly arranged about the center line for holding the paper sheets. Movement of one of the edge guides results in the corresponding movement of the other about the center line. With the use of a clutch disc, either paper guide may be moved independently of the other effectively changing the center line relative to the feed path of the transport.

6 Claims, 5 Drawing Sheets

ADJUSTABLE FEED TRAY ASSEMBLY

TECHNICAL FIELD OF THE INVENTION

This invention relates to paper handling and, in particular, to an adjustable paper tray for holding a quantity of sheet material wherein the paper tray is self-centering and capable of rapid adjustment. In addition, either paper side guide can be moved independently of the other effectively changing the center line of the document relative to the center line of the document transport.

BACKGROUND OF THE INVENTION

Document feeders on copiers, microfilmers, fax machines, printers and other business equipment rely on guides prior to feeding to align the documents. On some equipment, the guides move independently of one another and on other equipment, they are coupled with a rack and pinion arrangement which allows them to move together about the center line of the pinion gear.

U.S. Pat. No. 3,406,964 is directed to a pack holder for supporting a stack of sheet material to be fed therefrom. The pack holder is adjustable through equidistant sliding of parallel guide members. The guide members are mounted on pairs of gear racks. Pinion gears operatively associated with the gear racks rotate to slide the gear rack and the guide members. Rotation of the pinion gears is effected through a gear portion rotatably secured to the pack holder intermediate the pinion gears. A handle on the gear portion is used to rotate the gear portion and consequently adjust the guide members.

This provides improved paper trays by adapting the side guides for self-centering movement so that sheet material of various sizes may be accommodated in the pack holder which, in turn, can be positioned with a sheet forwarding mechanism.

Accordingly, the pack holder includes a platform with a pair of side guides supported thereon, each side guide having a pair of gear racks secured thereto and each meshing with a pinion gear secured for rotation to the base of the pack holder. Movement of the side guides is effected by means of a gear sector rotatably secured to the base of the pack holder and cooperating with the pinions. A handle is provided and secured to the section for manually rotating the gear sector and thereby causing rapid equidistant self-centering movement of the side guides.

U.S. Pat. No. 5,148,228 discloses a pair of sheet edge holders that are adjustably connected to each other using a gear unit. The apparatus is provided with a pair of edge holders opposedly arranged about the feed path for holding edge portions of the recording medium.

When feeding documents into a microfilm camera to obtain the maximum quality image on film, the document needs to be fed on the center of the transport system. This is where the feed and separating rollers are located in the feeder. In addition, when a document is fed on center, it is assured that it will travel under the optimum profile of the illumination system with the least amount of skew.

SUMMARY OF THE INVENTION

It is the object of the present invention to make it easier and smoother to move the paper guides to whatever position is required. The present invention provides an improvement over previous self-centering guides. With the use of a spring loaded slip clutch, either paper side guide may be moved independently of the other, thereby effectively changing the center line of the document relative to the center line of the transport.

This is an important feature when used, for example, on a microfilmer with a 40 X reduction ratio that requires the documents be fed off center, justified to the right, to assure that all of the documents are fed down the same center line and under that same section of the illumination and the same portion of the optical system, thereby assuring a more consistent resolution and uniform density.

BRIEF DESCRIPTION OF THE DRAWINGS

The above and other features and advantages of the present invention will become more apparent from the following detailed description taken with the accompanying drawings in which.

DETAILED DESCRIPTION OF THE INVENTION

Figure 1:
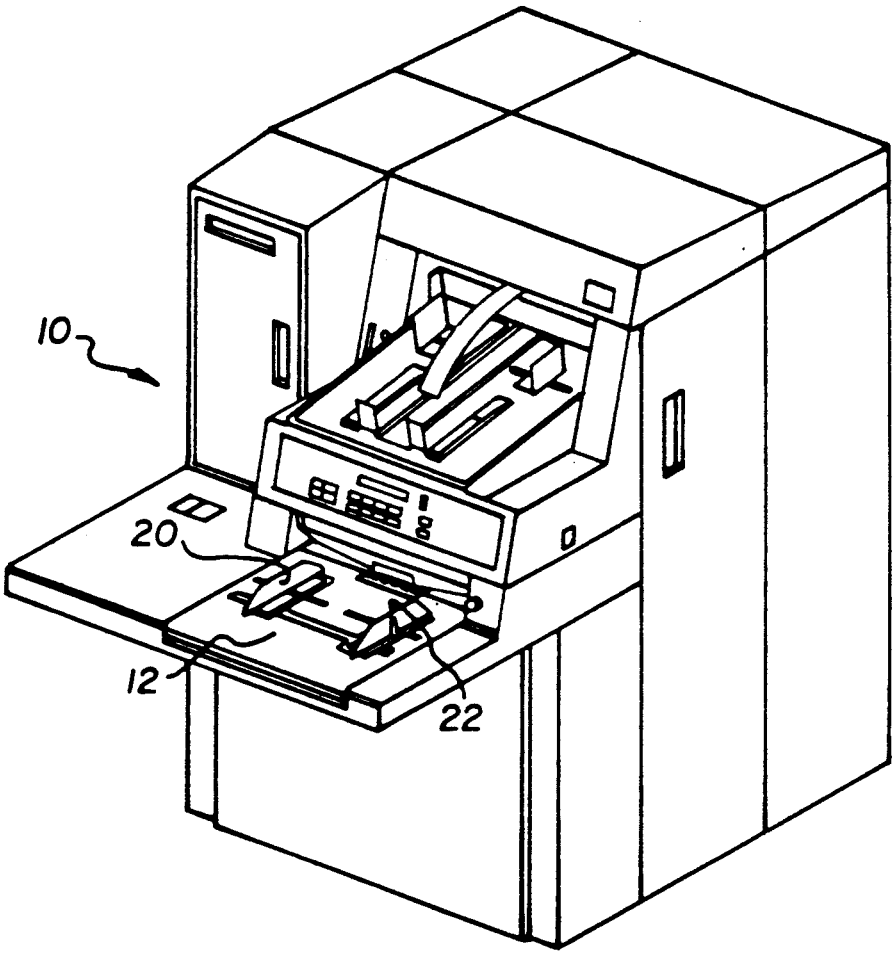
FIG. 1 is a perspective view of a microfilm camera showing the adjustable edge guides in the paper feed tray assembly in place.

FIG. 1 is a perspective view of a rotary microfilmer 10 illustrating a paper feed tray assembly 12 having an adjustable edge guides 20 and 22 according to the present invention. The feed tray assembly 12 can be removed from the image capture device, copier or the like, as a whole unit.

Figure 2:
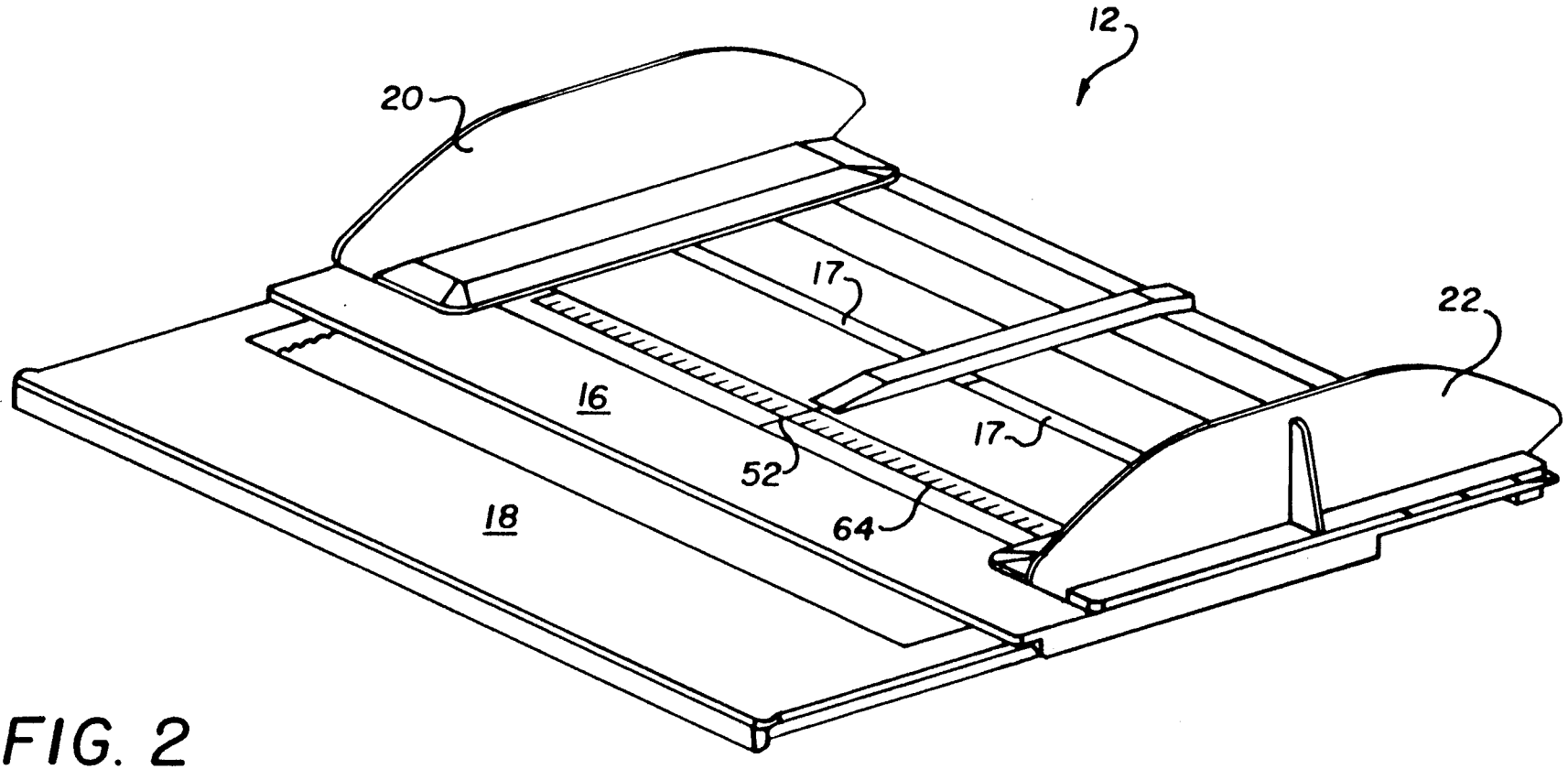
FIG. 2 is a perspective view of paper feed tray with the adjustable edge guides.
Figure 3:
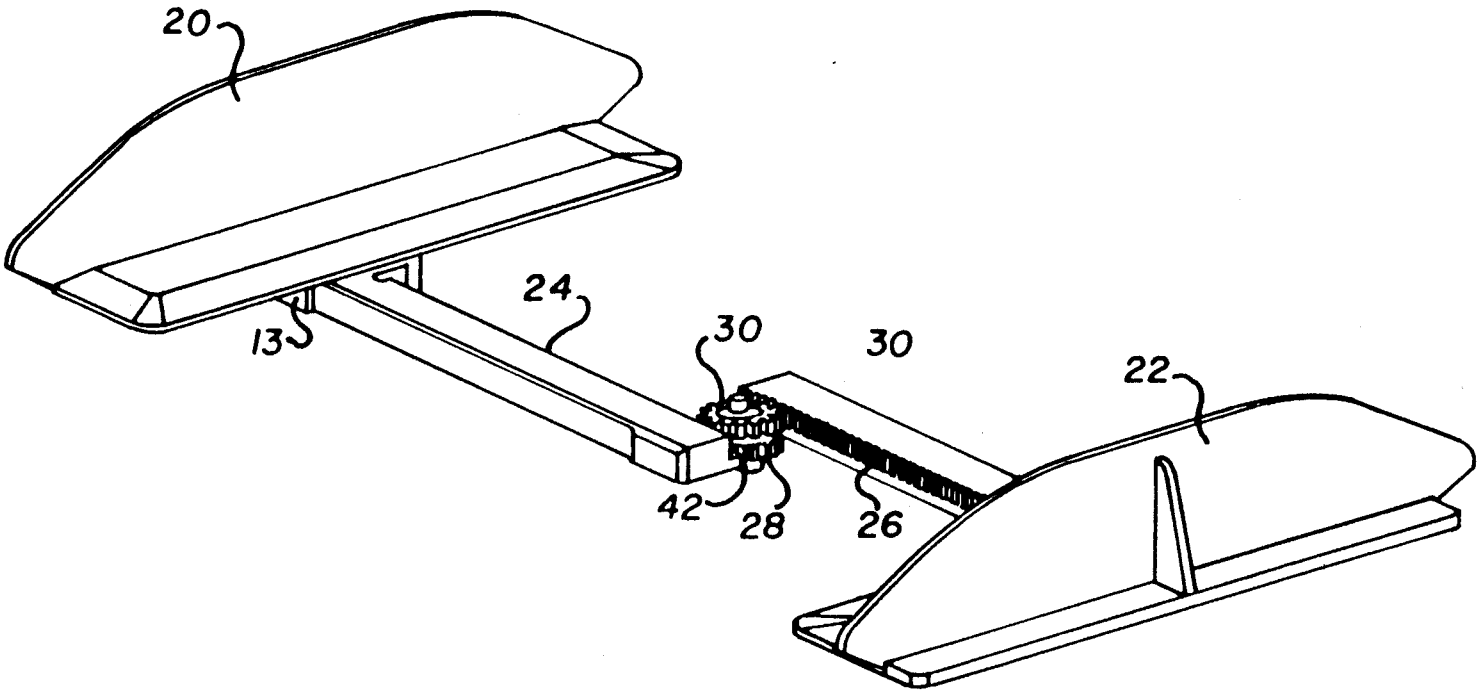
FIG. 3 is a perspective view of adjustable edge guides with the paper feed tray removed.

FIG. 2 illustrates the removed paper feed tray assembly 12 along with the feed tray extension 18 and the two adjustable side guides 20 and 22 which are left and right respectively, as seen in FIG. 2. The tabs 13 (see FIG. 3) on the adjustable side guides 20 and 22 are set onto slots 17 that are molded into the feed tray 16. Each rack 24 and 26 is attached to a tab 13 by a pair of screws (not shown), thereby securing the guides and racks together.

Figure 4:
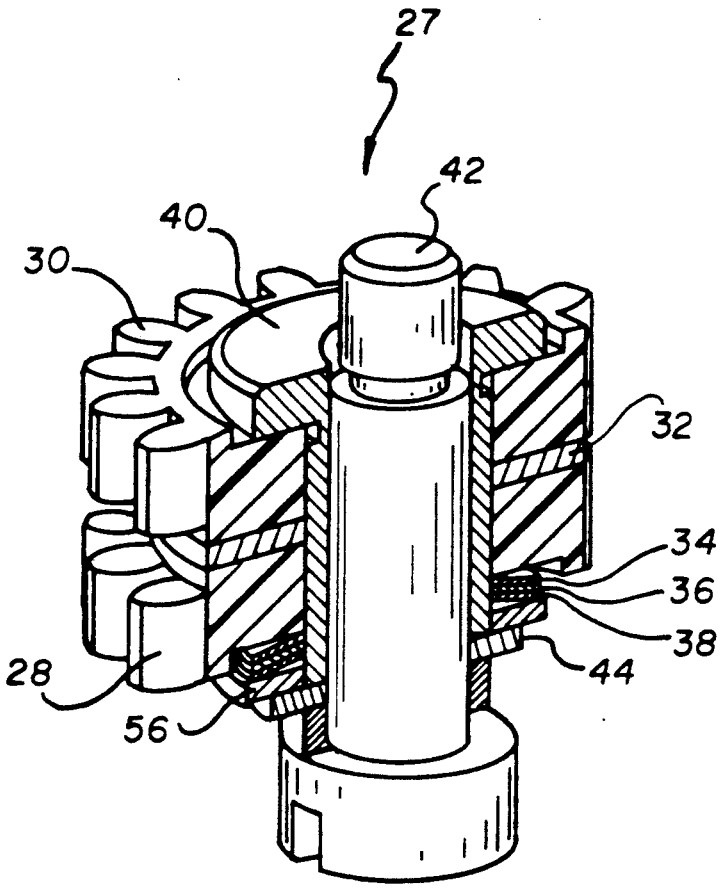
FIG. 4 is a perspective view of the clutch assembly.

Next, the pinion gear clutch assembly 27, as best seen in FIG. 4, will be described. The pinion gear 30 that will engage rack 26 is mounted on a bushing 40 so that the flange on bushing 40 sits inside the recess of pinion gear 30. A clutch disc 32 is slid onto bushing 40. The other pinion gear 28 is assembled onto the bushing 40 with its recess facing away from the clutch disc 32. Three bowed washers 34, 36 and 38 are then slid onto bushing 40 with the bowed edges facing the surface of pinion gear 28. A flat washer 56 is next assembled on top of the bowed washers 34, 36 and 38 on bushing 40 and everything is locked into place by inserting an "E" ring 44 into the groove on the end of bushing 40.

Figure 5:
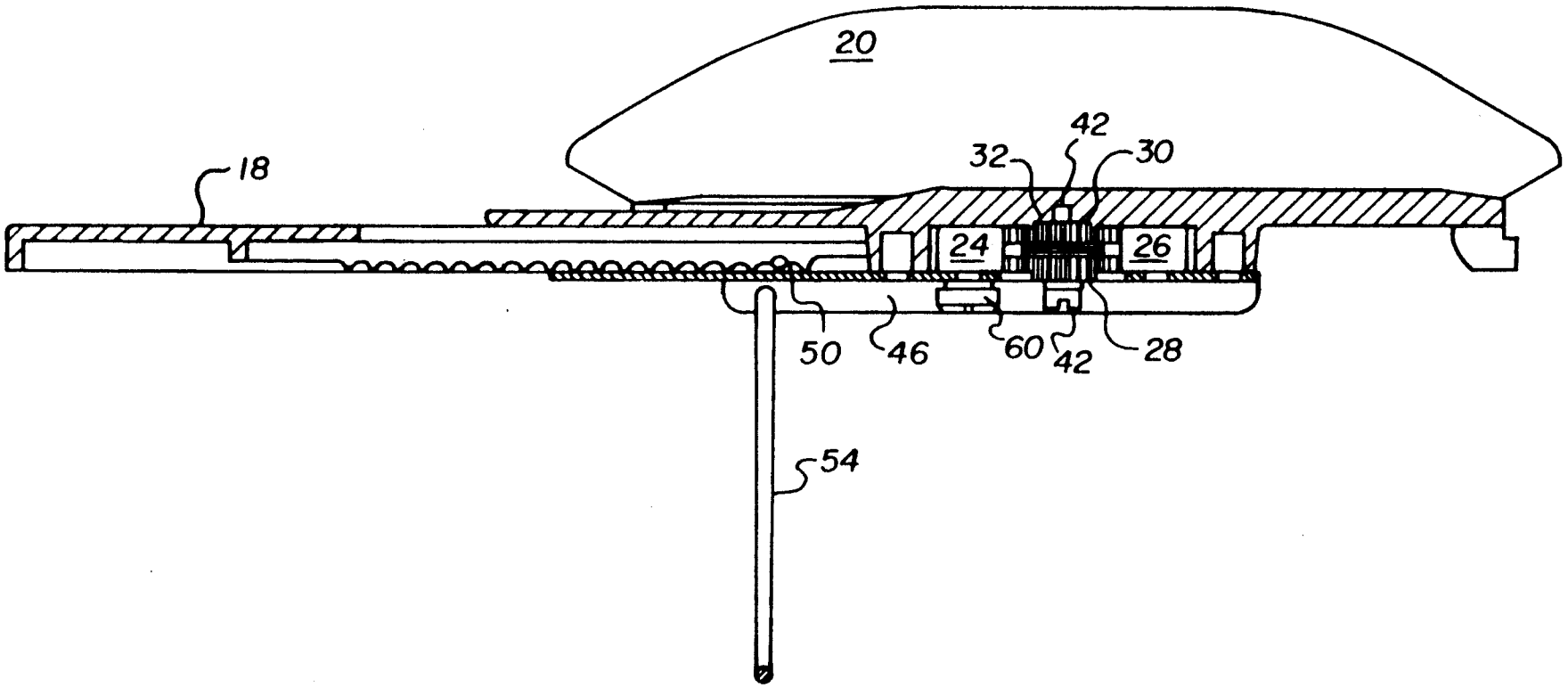
FIG. 5 is an elevational view with the feed tray partially in section showing the clutch assembly engaging respective racks connected to the adjustable side guides.

As shown in FIG. 5, this assembly is then mounted with a shoulder screw 42 onto the feed tray 16. As part of the assembly procedure, both side guides 20 and 22 are pushed toward the center position of the feed tray 16 until the tabs 13 (shown only on guide 20) are stopped at the end of the slots in feed tray 16.

As the pinion gear clutch assembly 27 is attached to feed tray 16, the pinion gears 28 and 30 can be rotated so that their teeth are aligned with each other. The teeth on the pinion gears 28 and 30 must mate with the respective gear teeth on racks 24 and 26. When this has been accomplished, the shoulder screw 42 is then secured into the threaded insert molded into feed tray 16 to finalize the assembly. Lastly, the feed tray extension 18 is slid in and the gear rack plate 46 is secured in place by several screws (not shown). Gear rack plate 46 retains the racks 24 and 25 in the paper feed tray assembly 12. Two ratchet springs 50 (shown only in FIG. 5) regulates the feed tray extension to a position that will accommodate an increase in paper length. Prop rod 54 is snapped into the holes of the gear rack plate 46 and is used to elevate the feed tray to a 45° angle where gravity is used to assist paper feeding. Knurled locking screws 60 are provided and may be tightened to hold the paper guides in a fixed position when use of the adjusting feature is not required.

OPERATION

To set the width between the adjustable side guides 20 and 22 for on-center feeding of sheets through an image capture device or copier, an operator grasps one of the side guides and moves it toward or away from the center line 52 and the other side guide will move in unison in the opposite direction with the side guide being moved manually. Because of the force exerted by the three bowed washers 34, 36 and 38 on the clutch disc 32, the clutch will not slip and the two pinion gears 28 and 30 rotate in either direction as a one-piece pinion gear.

However, if one wishes to feed a sheet through an image capture device such as a microfilm camera so that it is fed off center to the center line of the feed tray 16, the operator would grasp one adjustable side guide and hold it firmly in position so that it remains stationary and move the other side guide in the direction desired with a force greater than the combined force of the three bowed washers 34, 36 and 38. The operator can use the marked increments on the label 64 as an indicator for the accurate positioning of the side guides. Once adjusted to the distinct position by the operator, movement of either side guide will result in corresponding movement of the other side guide.

It should be noted that for extended use in a given position and set to a constant sheet width and positioned correctly relative to the transport center line, the side guides 20, 22 may be locked at that setting by tilting the feed tray 12 assembly upward and then tightening the two locking screws 60 that are fastened to racks 24 and 26.

We claim:

1. An adjustable stack holding apparatus for retaining a quantity of sheet material in line with a predetermined center line, said apparatus comprising:

a support tray having a pair of edge guides supported thereby and adapted for lateral movement relative to a center line;

gear racks carried by said support tray and attached to said edge guides;

a pair of pinion gears carried by said support tray and adapted to engage respective gear racks so that rotational movement of said pinion gears effects equidistant lateral movement of said edge guides;

means for controlling slippage between said pair of pinion gears such that independent rotational movement of said pinion gears is permitted when the forces on said edge guides exceeds a predetermined force thereby allowing for the establishment of a new and different center line.

2. The apparatus of claim 1 wherein said edge guides include a pair of single members each having a lateral base portion extending in a plane parallel to said support tray and an upright portion extending outwardly from said support tray.

3. The apparatus of claim 1 wherein the means for controlling slippage takes the form of a clutch disc between said pinion gears.

4. The apparatus according to claim 3 wherein the force required to cause slippage is determined by a plurality of bowed washers.

5. The apparatus according to claim 1 wherein said support tray is removable.

6. An adjustable holder for retaining a quantity of paper sheets comprising:

a support tray for receiving a plurality of paper sheets positioned with the center of said paper sheets being located at a center reference;

a pair of adjustable side guides arranged to retain and align the paper sheets being positioned on said support tray;

a rack member associated with each side guide;

a pinion gear associated with each rack member and engageable therewith;

a shaft for commonly supporting said pinion gears; and a clutch member disposed between said pair of pinion gears and operative so that below a predetermined force on said clutch said pinion gears rotate in unison such that said guides operate in unison and so that a force on said clutch member greater than said predetermined force allows each pinion gear to rotate independently of one another such that said side guides are movable independently of one another.

* * * * *